US009445192B2

(12) United States Patent
Ueno et al.

(10) Patent No.: US 9,445,192 B2
(45) Date of Patent: Sep. 13, 2016

(54) ACTIVE-NOISE-REDUCTION DEVICE, AND ACTIVE-NOISE-REDUCTION SYSTEM, MOBILE DEVICE AND ACTIVE-NOISE-REDUCTION METHOD WHICH USE SAME

(71) Applicant: Panasonic Intellectual Property Management Co., Ltd., Osaka (JP)

(72) Inventors: Shotaro Ueno, Mie (JP); Yoshio Nakamura, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 58 days.

(21) Appl. No.: 14/401,094

(22) PCT Filed: Jun. 21, 2013

(86) PCT No.: PCT/JP2013/003881

§ 371 (c)(1),
(2) Date: Nov. 13, 2014

(87) PCT Pub. No.: WO2014/002452

PCT Pub. Date: Jan. 3, 2014

(65) Prior Publication Data

US 2015/0104030 A1 Apr. 16, 2015

(30) Foreign Application Priority Data

Jun. 28, 2012 (JP) ..... 2012-144955

(51) Int. Cl.
*H04R 3/00* (2006.01)
*G10K 11/178* (2006.01)

(52) U.S. Cl.
CPC ..... *H04R 3/002* (2013.01); *G10K 11/178* (2013.01); *G10K 2210/1282* (2013.01); *G10K 2210/3055* (2013.01); *H04R 2499/13* (2013.01)

(58) Field of Classification Search
None
See application file for complete search history.

(56) References Cited

U.S. PATENT DOCUMENTS

2004/0247137 A1 12/2004 Inoue et al.
2009/0175461 A1* 7/2009 Nakamura ..... G10K 11/1788 381/71.1

FOREIGN PATENT DOCUMENTS

| | | |
|---|---|---|
| JP | 07-064573 | 3/1995 |
| JP | 08-006573 | 1/1996 |
| JP | 09-195790 | 7/1997 |
| JP | 2004-361721 | 12/2004 |

OTHER PUBLICATIONS

International Search Report of PCT application No. PCT/JP2013/003881 dated Aug. 6, 2013.

* cited by examiner

*Primary Examiner* — Curtis Kuntz
*Assistant Examiner* — Kenny Truong
(74) *Attorney, Agent, or Firm* — Panasonic IP Management; Kerry S. Culpepper

(57) ABSTRACT

A reference signal generating unit of an active-noise-reduction device of the present invention outputs a referencing signal having a correlation with a vibration to an adaptive filter unit. A filter coefficient update unit receives an input of an error signal, and successively updates a filter coefficient of the adaptive filter unit. The error signal is generated by a cancelling sound based on the output of the adaptive filter unit and noise. The detection unit detects a filter coefficient of the filter coefficient update unit, and determines a size of the output of the adaptive filter unit. Then, the amplitude of the cancelling sound is adjusted based on the size of the output of the adaptive filter unit estimated by the detection unit.

28 Claims, 6 Drawing Sheets

ACTIVE-NOISE-REDUCTION DEVICE, AND ACTIVE-NOISE-REDUCTION SYSTEM, MOBILE DEVICE AND ACTIVE-NOISE-REDUCTION METHOD WHICH USE SAME

This application is a U.S. national stage application of the PCT international application No. PCT/JP2013/003881.

TECHNICAL FIELD

The present technical field relates to an active-noise-reduction device which is mounted on a vehicle or the like and actively controls vibration noise such as an engine muffled sound, and an active-noise-reduction system, a mobile device, and an active-noise-reduction method, which use the same.

BACKGROUND ART

FIG. 6 is a circuit block diagram of conventional active-noise-reduction system 200. Active-noise-reduction system 200 reduces noise by carrying out adaptive control using an adaptive notch filter. Accordingly, active-noise-reduction system 200 includes reference signal generating unit 201, adaptive filter unit 202, cancelling-sound generating unit 203, error signal detection unit 206, and filter coefficient update unit 207.

Reference signal generating unit 201 outputs a reference signal having a correlation with noise generated from noise source 208. The reference signal is input into adaptive filter unit 202 from reference signal generating unit 201. Cancelling-sound generating unit 203 outputs cancelling sound 204 based on an output from adaptive filter unit 202.

Error signal detection unit 206 outputs an error signal. Note here that the error signal is generated by interference between cancelling sound 204 and noise 205 to be controlled. Filter coefficient update unit 207 determines, by calculation, a filter coefficient based on an input of the error signal from error signal detection unit 206. Then, filter coefficient update unit 207 outputs the filter coefficient determined by calculation to adaptive filter unit 202. Herein, filter coefficient update unit 207 determines, by calculation, the filter coefficient of adaptive filter unit 202 such that the error signal is minimized.

In active-noise-reduction system 200 configured as mentioned above, since the filter coefficient of adaptive filter unit 202 is updated toward the reduction of an error signal, the error signal is reduced. Then, active-noise-reduction system 200 reduces noise by repeating the processing in a specified period.

Note here that prior art literatures relating to the invention of the present application include, for example, PTL 1.

CITATION LIST

Patent Literature

PTL 1: Japanese Patent Unexamined Publication No. 2004-361721

SUMMARY OF THE INVENTION

An active-noise-reduction device of the present invention includes a first input terminal, a reference signal generating unit, an adaptive filter unit, an output terminal, a correction unit, a second input terminal, a filter coefficient update unit, and a detection unit.

A referencing signal having a correlation with noise is input into the first input terminal. The reference signal generating unit outputs a reference signal based on the referencing signal. The adaptive filter unit receives an input of the reference signal and outputs a cancelling signal. The cancelling signal is output via the output terminal.

The reference signal is input into the correction unit. Then, the correction unit corrects the reference signal based on simulated acoustic transfer characteristics data, and generates a correction reference signal. Note here that the simulated acoustic transfer characteristics data simulate the acoustic transfer characteristics of a signal transfer path of the cancelling signal.

An error signal based on a residual sound generated by a cancelling signal and noise is input into the second input terminal. Then, the filter coefficient update unit operates a filter coefficient of the adaptive filter unit based on the error signal and the correction reference signal, and successively updates the filter coefficient.

The detection unit detects the filter coefficient, and generates a control signal for adjusting an amplitude of the cancelling signal based on the detected filter coefficient. With the above-mentioned configuration, saturation of the filter coefficient can be suppressed. As a result, noise can be reduced excellently.

Furthermore, an active-noise-reduction system of the present invention includes a referencing signal source, an active-noise-reduction device, a cancelling sound source, an error signal detection unit, and an amplitude adjustment unit.

The referencing signal source generates a referencing signal. The active-noise-reduction device outputs a cancelling signal based on the referencing signal. The cancelling sound source outputs a cancelling sound based on the cancelling signal. The error signal detection unit outputs an error signal based on a residual sound. The amplitude adjustment unit is provided between the cancelling sound source and the adaptive filter unit. The amplitude adjustment unit is supplied with the control signal. The amplitude adjustment unit adjusts an amplitude of the cancelling signal based on the control signal.

Furthermore, an active-noise-reduction method of the present invention includes generating a reference signal, generating a cancelling signal, updating a filter coefficient, detecting the filter coefficient, and generating a signal for adjusting an amplitude. The generating of the reference signal generates a reference signal having a correlation with noise generated from a noise source. The generating of the cancelling signal generates the cancelling signal by using an adaptive filter based on the generated reference signal. The updating of the filter coefficient updates the filter coefficient of the adaptive filter based on an error signal. Note here that the error signal is generated by interference between noise and the cancelling signal. The detecting of the filter coefficient detects the updated filter coefficient. The generating of a signal for adjusting an amplitude generates a signal for adjusting the amplitude of the cancelling signal in response to the filter coefficient detected in the detecting of the filter coefficient.

The thus updated filter coefficient is detected, and the amplitude of the cancelling signal is adjusted in response to the detected filter coefficient. The above-mentioned configuration can suppress saturation of the filter coefficient. As a result, noise can be reduced excellently.

DESCRIPTION OF EMBODIMENTS

Recently, active-noise-reduction devices for reducing noise heard by a driver or a passenger by cancelling, in an automobile, noise generated during operation (running) of an automobile or the like, have been put into practical use. However, in conventional active-noise-reduction system 200, when noise 205 to be controlled is large, a filter coefficient of adaptive filter unit 202 is saturated. When the filter coefficient of adaptive filter unit 202 is saturated, an effect of reducing noise lowers. Thus, an object of the present invention is to solve the above-mentioned problems and to provide an active-noise-reduction device capable of obtaining an excellent noise reduction effect. Note here that the saturation of the filter coefficient means a case in which an upper limit value or a lower limit value determined by bit of microcomputer to be used for operation is calculated.

Figure 1:
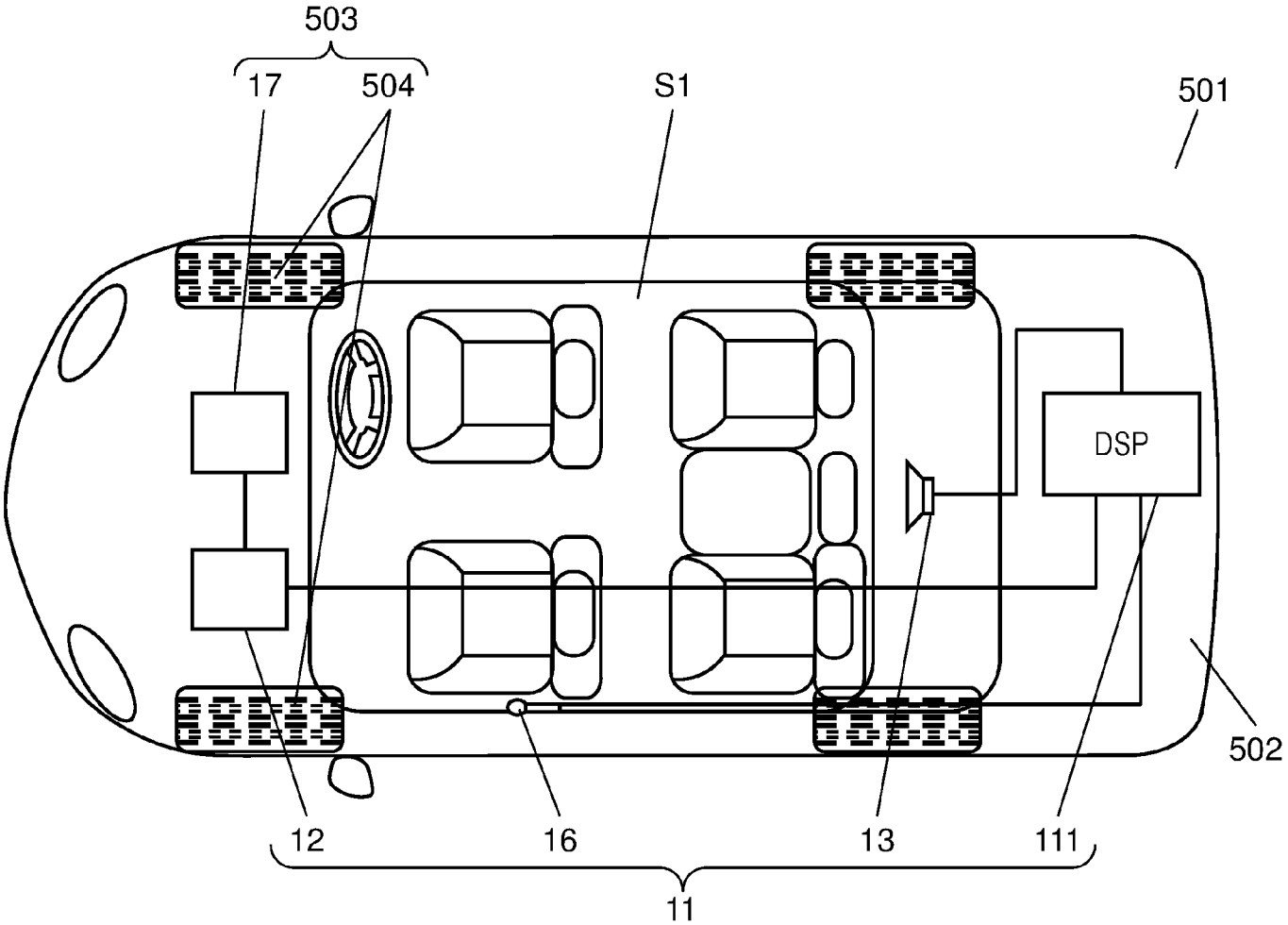
FIG. 1 is a conceptual diagram of a mobile device on which an active-noise-reduction system is mounted in accordance with an exemplary embodiment of the present invention.
Figure 2:
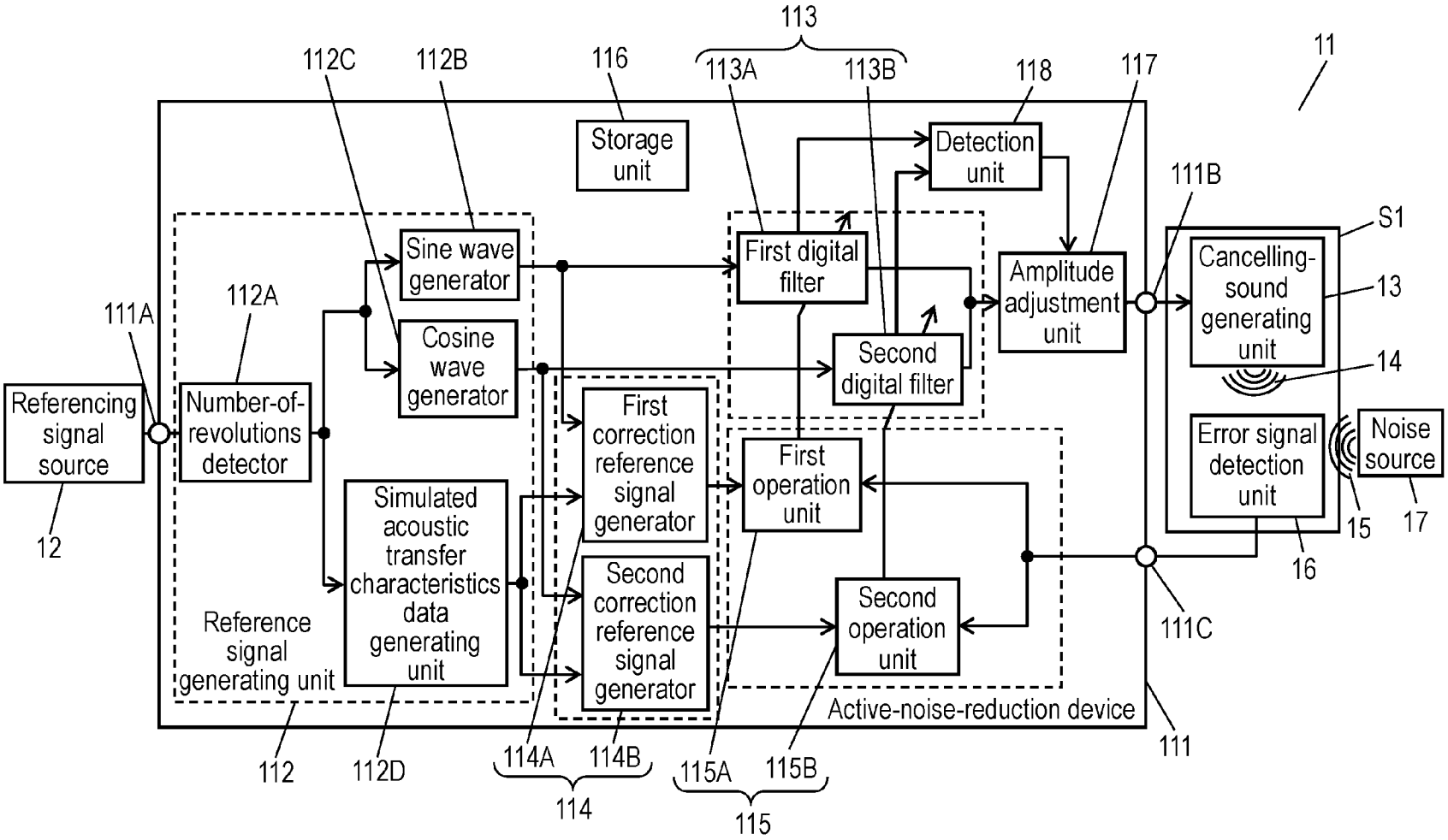
FIG. 2 is a circuit block diagram of the active-noise-reduction system in accordance with the exemplary embodiment of the present invention.

Hereinafter, a configuration of active-noise-reduction system 11 in accordance with an exemplary embodiment of the present invention is described with reference to drawings. FIG. 1 is a conceptual diagram of a mobile device using an active-noise-reduction system in accordance with the exemplary embodiment of the present invention. FIG. 2 is a circuit block diagram of the active-noise-reduction system in accordance with the exemplary embodiment of the present invention.

As shown in FIG. 1, mobile device 501 includes device main body 502, drive unit 503, space S1, and active-noise-reduction system 11. Device main body 502 may include, for example, a chassis and a body of mobile device 501. Device main body 502 is provided with space S1 inside thereof. Furthermore, main body 502 is equipped with drive unit 503 and active-noise-reduction system 11.

Mobile device 501 is, for example, an automobile. Drive unit 503 is configured to include noise source 17, tire 504, and the like. Note here that mobile device 501 is not necessarily limited to an automobile. Mobile device 501 may be, for example, an aircraft and a ship. Furthermore, noise source 17 is, for example, power sources such as an engine and a motor. Space 51 accommodates a driver who drives mobile device 501 or a passenger who boards on mobile device 501. Note here that it is preferable that drive unit 503 is placed in a space other than space 51. For example, drive unit 503 can be placed inside a space under the bonnet of device main body 502.

As shown in FIGS. 1 and 2, active-noise-reduction system 11 includes active-noise-reduction device 111, referencing signal source 12, cancelling-sound generating unit 13, and error signal detection unit 16. It is preferable that active-noise-reduction device 111 is configured in a signal processing circuit. In this case, active-noise-reduction device 111 operates for each reference clock whose period is T (second). Hereinafter, the present time point is defined as the n-th period.

Referencing signal source 12 generates a referencing signal. Note here that the referencing signal has a correlation with noise 15 to be controlled, which is generated by noise source 17. When noise source 17 is an engine or a motor, noise generated by noise source 17 has a correlation with the number of revolutions of the engine or the motor. Thus, it is preferable that a control signal for controlling the number of revolutions of noise source 17 is used for the referencing signal. Therefore, when noise source 17 is an engine, an engine pulse signal can be used for the referencing signal. In this case, a control circuit for controlling noise source 17 can be used for referencing signal source 12.

Note here that the referencing signal is not necessarily limited to a control signal for controlling the number of revolutions of noise source 17. For example, as referencing signal source 12, a sensor for sensing the number of revolutions of noise source 17 can be used. In this case, the sensor outputs the sensed number of revolutions of noise source 17 as the referencing signal.

The output from referencing signal source 12 is supplied to active-noise-reduction device 111. Active-noise-reduction device 111 generates cancelling signal z(n) based on the referencing signal.

Cancelling-sound generating unit 13 is supplied with cancelling signal z(n). Cancelling-sound generating unit 13 is a transducer. Namely, cancelling-sound generating unit 13 converts cancelling signal z(n) into cancelling sound 14, and outputs cancelling sound 14 to space S1. Therefore, it is preferable that cancelling-sound generating unit 13 is configured to include a low-pass filter (LPF), a power amplifier, a loudspeaker, or the like.

Error signal detection unit 16 outputs error signal e(n). Error signal e(n) is generated based on an interference sound (synthesized sound) of cancelling sound 14 and noise 15 generated by noise source 17. Therefore, it is preferable that error signal detection unit 16 is configured to include a high-pass filter (HPF), a power amplifier, a low-pass filter (LPF), and the like. Furthermore, error signal detection unit 16 may include an A/D converter.

Cancelling sound 14 output from cancelling-sound generating unit 13 and noise 15 generated by noise source 17 interfere with each other to be synthesized in the air. At this time, when a phase difference between cancelling sound 14 and noise 15 is 180°, and when the amplitudes thereof are the same as each other, noise 15 is completely deleted. However, when the phase difference between cancelling sound 14 and noise 15 is displaced from 180°, or when the amplitudes are not equal to each other, error signal detection unit 16 outputs error signal e(n) based on the interference sound between cancelling sound 14 and noise 15.

Next, a configuration of active-noise-reduction device 111 is described with reference to FIG. 2. Active-noise-reduction device 111 includes first input terminal 111A, output terminal 111B, second input terminal 111C, reference signal generating unit 112, adaptive filter unit 113, correction unit 114, filter coefficient update unit 115, storage unit 116, amplitude adjustment unit 117, and detection unit 118.

Reference signal generating unit 112, adaptive filter unit 113, correction unit 114, filter coefficient update unit 115, amplitude adjustment unit 117, and detection unit 118 can be configured in a signal processing device. For the signal processing device, for example, DSP, microcomputer, and the like, can be used. Therefore, active-noise-reduction device 111 can be miniaturized. Note here that all of reference signal generating unit 112, adaptive filter unit 113, correction unit 114, filter coefficient update unit 115, amplitude adjustment unit 117, and detection unit 118 are implemented in a period of T (sec).

A referencing signal is input into first input terminal 111A. Reference signal generating unit 112 outputs a reference signal having a correlation with noise 15 generated from noise source 17. Adaptive filter unit 113 outputs cancelling signal z(n) based on the reference signal input from reference signal generating unit 112. Then, cancelling signal z(n) is output from output terminal 111B through amplitude adjustment unit 117.

Storage unit 116 stores simulated acoustic transfer characteristics data which simulate acoustic transfer characteristics of a signal transfer path of a cancelling signal. A reference signal is input into correction unit 114. With this configuration, correction unit 114 corrects the reference signal based on the simulated acoustic transfer characteristics data and generates a correction reference signal. Note here that exchanges of signals between storage unit 116 and other components are not shown.

Error signal e(n) is input into second input terminal 111C. A correction reference signal and error signal e(n) are input into filter coefficient update unit 115. Then, filter coefficient update unit 115 successively updates a filter coefficient to be used in adaptive filter unit 113 based on the correction reference signal and error signal e(n). In this case, filter coefficient update unit 115 determines the filter coefficient by calculation such that error signal e(n) is reduced, and outputs the filter coefficient to adaptive filter unit 113. As a result, adaptive filter unit 113 updates the present filter coefficient into the new filter coefficient input from filter coefficient update unit 115.

Detection unit 118 detects the filter coefficient determined by calculation in filter coefficient update unit 115. Then, detection unit 118 generates a control signal for adjusting an amplitude of cancelling signal z(n) based on the detected filter coefficient.

Amplitude adjustment unit 117 is provided between adaptive filter unit 113 and cancelling-sound generating unit 13. Amplitude adjustment unit 117 is supplied with the control signal output from detection unit 118. With this configuration, amplitude adjustment unit 117 changes the amplitude of cancelling signal z(n) based on the control signal input from detection unit 118. As a result, the amplitude of cancelling sound 14 is changed.

Note here that it is preferable that amplitude adjustment unit 117 and detection unit 118 are provided between adaptive filter unit 113 and output terminal 111B. With this configuration, since amplitude adjustment unit 117 can be easily configured in the signal processing device, active-noise-reduction device 111 can be miniaturized. Furthermore, amplitude adjustment unit 117 may include a D/A converter. In this case, cancelling signal z(n), which has been converted into an analog signal, is output from adaptive filter unit 113.

With the above-mentioned configuration, detection unit 118 can detect whether or not the filter coefficient is saturated. Therefore, when detection unit 118 detects that the filter coefficient of adaptive filter unit 113 is saturated, detection unit 118 can adjust the amplitude of cancelling signal z(n) so as to eliminate the saturation of the filter coefficient. As a result, the amplitude of cancelling sound 14 can be adjusted based on the control signal output by detection unit 118. Therefore, since the saturation of the filter coefficient of adaptive filter unit 113 is suppressed, noise can be reduced excellently.

Next, active-noise-reduction device 111 is described in more detail. Reference signal generating unit 112 generates a reference signal having a correlation with noise 15 generated form noise source 17. Therefore, reference signal generating unit 112 includes number-of-revolutions detector 112A, sine wave generator 112B, and cosine wave generator 112C. Reference signal generating unit 112 may further include simulated acoustic transfer characteristics data generating unit 112D. Note here that in addition to a configuration in which reference signal generating unit 112 includes simulated acoustic transfer characteristics data generating unit 112D, for example, a configuration in which correction unit 114 includes simulated acoustic transfer characteristics data generating unit 112D may be employed.

A frequency of noise 15 changes depending upon the number of revolutions of noise source 17. Namely, a referencing signal output from referencing signal source 12 has a correlation with the number of revolutions of noise source 17. Therefore, number-of-revolutions detector 112A can detect the number of revolutions of noise source 17 based on the referencing signal. As a result, number-of-revolutions detector 112A can output control frequency f(n) in proportion to the number of revolutions.

For example, a case where an engine pulse signal is used as the referencing signal is described. The engine pulse signal is a pulse string. A frequency of the pulse string is proportion to the number of revolutions of noise source 17, for example, an engine or a motor. Therefore, number-of-revolutions detector 112A generates control frequency f(n) based on the pulse string. For example, number-of-revolutions detector 112A generates an interrupt for each rising edge of the engine pulse (a pulse string) and measures the time between the rising edges. Furthermore, number-of-revolutions detector 112A outputs control frequency f(n) based on the time between the measured rising edges.

Reference signal generating unit 112 includes sine wave generator 112B and cosine wave generator 112C. Sine wave generator 112B and cosine wave generator 112C generate a reference signal by using control frequency f(n) and sine value data stored in storage unit 116. Then, sine wave generator 112B and cosine wave generator 112C read out data from storage unit 116 at a specified point interval based on control frequency f(n) for each sampling period. As a result, since reference signal generating unit 112 can generate a reference signal in response to control frequency f(n), the reference signal has a correlation with the noise generated by noise source 17.

Therefore, storage unit 116 stores a table of prescribed bit discrete sine wave data. This table includes points obtained by dividing one period of the sine wave into N equal parts and corresponding sine value data at respective points.

For example, storage unit 116 stores one period of the discrete sine value data obtained by dividing the sine wave corresponding to 1 Hz into N equal parts. When a sequence including sine values from point 0 to point (N−1), which are b-bit discrete and are stored, is represented by s(m) ($0 \le m < N$), the following Formula (1) is satisfied, where int(x) denotes an integer portion of x and the unit of an angle of the sin function is degree (°).

[Math. 1]

$$s(m)=\mathrm{int}(2^{b1}\times\sin(360\times m/N)) \quad \text{Formula (1)}$$

Reference signal generating unit 112 includes sine wave generator 112B and cosine wave generator 112C. Reference signal generating unit 112 outputs reference sine wave signal x1(n) and reference cosine wave signal x2(n) based on the referencing signal. Therefore, control frequency f(n) is supplied to sine wave generator 112B and cosine wave generator 112C. Sine wave generator 112B outputs reference sine wave signal x1(n) based on control frequency f(n). On the other hand, cosine wave generator 112C generates reference cosine wave signal x2(n) based on control frequency f(n).

As a result, sine wave generator 112B outputs reference sine wave signal x1(n) having a frequency of f(n). On the other hand, cosine wave generator 112C outputs reference cosine wave signal x2(n) having a frequency of f(n). Note here that the phase of reference sine wave signal x1(n) and that of reference cosine wave signal x2(n) are different from each other by 90°.

For example, when control frequency f(n) is m, reference signal generating unit 112 reads out sine value data at a point, which is m points ahead from the previously read-out point, as a present point. Therefore, the reference signal correlates with vibration generated from the noise source.

Sine wave generator 112B determines, by calculation, the present read-out point by moving for each period from Formula (2). In other words, sine wave generator 112B stores the previously read-out point j(n−1) of storage unit 116 in a memory, and determines the present read-out point j(n) by calculation based on the previously read-out point j(n−1) and control frequency f(n). However, when the calculation result of the right side of Formula (2) is N or more, a value obtained by subtracting N from the calculation result is assigned to j(n).

[Math. 2]

$$j(n)=j(n-1)+(N\times f(n)\times T) \quad \text{Formula (2)}$$

Furthermore, sine wave generator 112B generates reference sine wave signal x1(n) having the same frequency as control frequency f(n). Note here that sine wave generator 112B generates reference sine wave signal x1(n) represented by Formula (3). However, when the calculation result of j(n) in the right side of Formula (3) is N or more, a value obtained by subtracting N from the calculation result is assigned to j(n).

[Math. 3]

$$x1(n)=s(j(n)) \quad \text{Formula (3)}$$

Similar to sine wave generator 112B, cosine wave generator 112C generates a signal having the same frequency as control frequency f(n). Note here that cosine wave generator 112C generates reference cosine wave signal x2(n) represented by Formula (4). However, the calculation result of j(n)+N/4 in the right side of Formula (4) is N or more, a value obtained by subtracting N from the calculation result is assigned to j(n)+N/4.

[Math. 4]

$$x2(n)=s(j(n)+N/4) \quad \text{Formula (4)}$$

By the transfer characteristics between adaptive filter unit 113 and filter coefficient update unit 115, a phase delay, gain reduction, or the like, occurs in error signal e(n). Furthermore, such phase delay and gain reduction are different depending upon the frequency of cancelling sound 14. Therefore, simulated acoustic transfer characteristics data generating unit 112D is supplied with control frequency f(n). Simulated acoustic transfer characteristics data generating unit 112D outputs simulated acoustic transfer characteristics data corresponding to f(n) to correction unit 114. For the simulated acoustic transfer characteristics data, it is preferable to use characteristics conversion value P(f) for correcting the phase and gain correction value Gain(k). Namely, the simulated acoustic transfer characteristics data simulate acoustic transfer characteristics of the transfer path between the time when cancelling signal z(n) is output to the time when error signal e(n) reaches filter coefficient update unit 115.

Characteristics conversion value P(f) and gain correction value Gain(k) are stored in storage unit 116 in such a manner that they correspond to control frequency f(n). Note here that control frequency f(n) may be stored in a state in which it is converted into a move amount of the number of points in sine wave generator 112B or cosine wave generator 112C.

TABLE 1

| Frequency (Hx) | Gain (dB) | Phase (°) |
|---|---|---|
| k | Gain [k] | Phase [k] |
| k1 | Gain [k1] | Phase [k1] |
| k2 | Gain [k2] | Phase [k2] |
| . . . | . . . | . . . |
| k100 | Gain [k100] | Phase [k100] |

For example, as shown in Table 1, storage unit 116 stores phase correction values and gain correction values corresponding to control frequencies f(n) from k (Hz) to k100 (Hz).

Simulated acoustic transfer characteristics data generating unit 112D reads, from storage unit 116, phase correction value Phase[k] stored corresponding to control frequency f(n), and determines, by calculation, characteristics conversion value P[f] as shown in Formula (5). Herein, the phase correction value is defined as Phase[k]) (°) and the gain correction value is defined as Gain[k] (dB) when the frequency is k(Hz).

[Math. 5]

$$P[f]=\mathrm{int}(N\times\mathrm{Phase}\ [k]/360) \quad \text{Formula (5)}$$

Adaptive filter unit 113 outputs cancelling signal z(n) based on a reference signal output from reference signal generating unit 112. Adaptive filter unit 113 generates cancelling signal z(n) by using an adaptive filter based on the reference signal. For adaptive filter unit 113, a 1-tap adaptive filter can be used. Adaptive filter unit 113 includes first digital filter 113A and second digital filter 113B. First digital filter 113A outputs first control signal y1(n) based on reference sine wave signal x1(n) output from sine wave generator 112B. On the other hand, second digital filter 113B outputs second control signal y2(n) based on reference cosine wave signal x2(n) output from cosine wave generator 112C.

First digital filter 113A stores first filter coefficient W1(n) inside thereof. On the other hand, second digital filter 113B stores second filter coefficient W2(n) inside thereof. Then, first digital filter 113A assigns weight to reference sine wave signal x1(n) by first filter coefficient W1(n) so as to generate first control signal y1(n). Furthermore, second digital filter 113B assigns weight to reference cosine wave signal x2(n) by second filter coefficient W2(n) so as to generate first control signal y1(n). Furthermore, in adaptive filter unit 113, addition of first control signal y1(n) and second control signal y2(n) is carried out so as to generate cancelling signal z(n).

Correction unit 114 corrects a reference signal based on the input simulated acoustic transfer characteristics data so as to generate a correction signal. For example, correction unit 114 reads characteristics conversion value P(f) and gain correction value Gain(k) of simulated acoustic transfer characteristics data generating unit 112D in control frequency f(n). Then, correction unit 114 outputs the generated correction signal to filter coefficient update unit 115.

It is preferable that correction unit 114 includes first correction reference signal generator 114A and second correction reference signal generator 114B. In this case, reference sine wave signal x1(n) and simulated acoustic transfer characteristics data are input into first correction reference signal generator 114A. Then, first correction reference signal generator 114A generates correction sine wave signal r1(n) from Formula (6). However, when the calculation result of j(n)+P(f) in the right side of Formula (6) is N or more, a value obtained by subtracting N from the calculation result is assigned to j(n)+P(f).

[Math. 6]

$$r1(n)=10^{Gain(k)/20}\times s(j(n)+P(f)) \quad \text{Formula (6)}$$

On the other hand, reference cosine wave signal x2(n) and the simulated acoustic transfer characteristics data are input into second correction reference signal generator 114B. Then, second correction reference signal generator 114B generates correction cosine wave signal r2(n) from Formula (7). However, when the calculation result of j(n)+N/4+P(f) in the right side of Formula (7) is N or more, a value obtained by subtracting N from the calculation result is assigned to j(n)+N/4+P(f).

[Math. 7]

$$r2(n)=10^{Gain(k)/20}\times s(j(n)+N/4+P(f)) \quad \text{Formula (7)}$$

It is preferable that filter coefficient update unit 115 is configured to include first operation unit 115A and second operation unit 115B. First operation unit 115A and second operation unit 115B are supplied with error signal e(n). Furthermore, first operation unit 115A is supplied with correction sine wave signal r1(n). On the other hand, second operation unit 115B is supplied with correction cosine wave signal r2(n).

First operation unit 115A operates first filter coefficient W1(n) based on correction sine wave signal r1(n) such that error signal e(n) is minimized. Then, first operation unit 115A successively updates first filter coefficient W1(n). On the other hand, second operation unit 115B operates second filter coefficient W2(n) based on correction cosine wave signal r2(n) such that error signal e(n) is minimized. Then, second operation unit 115B successively updates second filter coefficient W2(n). Note here that it is preferable that first filter coefficient W1(n) and second filter coefficient W2(n) are values ranging from, for example, −1 to 1.

An operation in which filter coefficient update unit 115 updates first filter coefficient W1(n) and second filter coefficient W2(n) so as to reduce noise 15 is described.

Updating formulae of first filter coefficient W1(n) and second filter coefficient W2(n) are represented by Formula (8) and Formula (9), respectively.

Herein, μ denotes a scalar quantity, which is a step-size parameter for deciding an update quantity of the adaptive filter for each sampling; r1(n) denotes a correction sine wave signal; r2(n) denotes a correction cosine wave signal; and e(n) denotes an error signal.

[Math. 8]

$$W1(n)=W1(n-1)-\mu\times r1(n)\times e(n) \quad \text{Formula (8)}$$

[Math. 9]

$$W2(n)=W2(n-1)-\mu\times r2(n)\times e(n) \quad \text{Formula (9)}$$

Next, a principle that cancelling sound 14 reduces noise 15 by using first filter coefficient W1(n) and second filter coefficient W2(n) is described.

Where B(t) is noise 15, f (Hz) is a frequency of noise 15, Amp is amplitude, and ϕ (rad) is a phase, B(t) can be represented by Formula (10). Note here that t denotes time.

[Math. 10]

$$B(t)=\text{Amp}\times\sin(2\pi\times f\times t+\phi) \quad \text{Formula (10)}$$

When ideal cancelling sound 14 that is allowed to interfere with noise 15 (B(t)) is denoted by A(t), A(t) only needs to have the same amplitude as and an opposite phase to those of B(t). Therefore, A(t) can be represented by Formula (11) and Formula (12).

[Math. 11]

$$A(t) = Amp\times\sin(2\pi\times f\times t+(\phi-\pi) \quad \text{Formula (11)}$$

$$= W1\times\sin(2\pi\times f)+W2\times\cos(2\pi\times f) \quad \text{Formula (12)}$$

where $(\text{Amp})^2=(\text{W1})^2+(\text{W2})^2$ $$\tan(\phi-\pi)=(W2)/(W1)$$

As shown in Formula (11) and Formula (12), when the sizes of first filter coefficient W1(n) and second filter coefficient W2(n) are changed, the amplitude of cancelling sound 14 is changed. Furthermore, when the ratio of first filter coefficient W1(n) and second filter coefficient W2(n) is changed, a phase of cancelling sound 14 can be changed.

The filter coefficient determined by calculation by filter coefficient update unit 115 in this way is output to adaptive filter unit 113. As a result, the filter coefficient of adaptive filter unit 113 is rewritten into the filter coefficient determined by calculation by filter coefficient update unit 115. When the above-mentioned operation is repeated, the filter coefficient is updated sequentially such that error signal e(n) becomes smaller. With the above-mentioned configuration and operation, active-noise-reduction system 11 reduces noise 15. However, when a value of error signal e(n) is extremely large, first filter coefficient W1(n) or second filter coefficient W2(n) becomes larger. Therefore, saturation of first filter coefficient W1(n) or second filter coefficient W2(n) may occur. When the filter coefficient is saturated, since the amplitude of cancelling signal z(n) cannot be further increased, a noise reduction effect is deteriorated.

Thus, active-noise-reduction system 11 includes amplitude adjustment unit 117 and detection unit 118, and suppresses the deterioration of the noise reduction effect due to saturation of the filter coefficient.

Cancelling signal z(n) and the control signal output from detection unit 118 are input into amplitude adjustment unit 117. Then, amplitude adjustment unit 117 adjusts the amplitude of cancelling signal z(n) based on the control signal, and supplies the cancelling signal z(n) to output terminal 111B. As a result, the amplitude of cancelling sound 14 output from cancelling-sound generating unit 13 is changed.

Amplitude adjustment unit 117 is configured inside the signal processing device. Therefore, amplitude adjustment unit 117 can be configured of, for example, a digital variable resistor. In this case, it is preferable that amplitude adjustment unit 117 stores a value of amplitude coefficient R(n) inside thereof. As shown in Formula 13, amplitude adjustment unit 117 can be configured to adjust the amplitude of cancelling signal z(n) according to the value of the amplitude coefficient R(n). Therefore, by changing the value of amplitude coefficient R(n), an amplitude of analog-converted cancelling signal z(n) is changed. Note here that A(n) denotes a size of cancelling sound 14.

[Math. 12]

$$A(n)=R(n)\times(y1(n)+y2(n)) \quad \text{Formula (13)}$$

Detection unit 118 detects first filter coefficient W1(n) of first digital filter 113A and second filter coefficient W2(n) of second digital filter 113B. Then, detection unit 118 generates a value of amplitude coefficient R(n) based on the detected filter coefficient.

Note here that detection unit 118 detects both first filter coefficient W1(n) and second filter coefficient W2(n), but the configuration is not limited to this. Detection unit 118 may be configured to sense only one of first filter coefficient W1(n) and second filter coefficient W2(n). Furthermore, detection unit 118 detects a filter coefficient from adaptive filter unit 113, but the configuration is not limited to this. For example, detection unit 118 may be configured to obtain a filter coefficient from filter coefficient update unit 115.

As mentioned above, active-noise-reduction device 111 has detection unit 118, and therefore can sense first filter coefficient W1(n) of first digital filter 113A and second filter coefficient W2(n) of second digital filter 113B. Furthermore, when detection unit 118 determines that the sensed filter coefficient is saturated, it changes the value of amplitude coefficient R(n). Thus, amplitude adjustment unit 117 adjusts the amplitude of cancelling sound 14, so that saturation of first filter coefficient W1(n) or second filter coefficient W2(n) can be suppressed. Therefore, an excellent noise reduction effect can be achieved. In addition, the frequency of actually occurring noise can be appropriately reduced. Furthermore, it is possible to prevent uncomfortable noise having a frequency, which does not actually occurs, from being radiated.

Next, detection unit 118 is described in more detail. Detection unit 118 detects the updated filter coefficient, and outputs a control signal based on the detected filter coefficient to amplitude adjustment unit 117. For example, detection unit 118 determines whether or not the filter coefficient is saturated. Then, detection unit 118 decides the value of amplitude coefficient R(n) based on the determined results. Furthermore, detection unit 118 outputs the value of amplitude coefficient R(n) to amplitude adjustment unit 117.

Note here that it is preferable that detection unit 118 judges that the filter coefficient is saturated when detection unit 118 judges that at least one of first filter coefficient W1(n) and second filter coefficient W2(n) is saturated. Then, detection unit 118 changes the value of amplitude coefficient R(n) when detection unit 118 determines that the filter coefficient is in a saturated state. On the other hand, detection unit 118 does not change the value of amplitude coefficient R(n) when detection unit 118 determines that the filter coefficient is in a non-saturation state.

When detection unit 118 determines that the filter coefficient is in a saturation state, detection unit 118 changes the value of amplitude coefficient R(n) such that cancelling sound 14 is increased. As a result, the amplitude of the output signal from amplitude adjustment unit 117 is increased. Then, when detection unit 118 determines that the filter coefficient is still in a saturation state even after the above-mentioned operation is carried out, detection unit 118 further changes the value of amplitude coefficient R(n). This operation is repeated until it is determined that the saturation state of the filter coefficient is eliminated and the filter coefficient become in a non-saturation state. Note here that when it is determined that that the saturation state of the filter coefficient is eliminated, detection unit 118 maintains the value of amplitude coefficient R(n).

With the operation as mentioned above, when detection unit 118 determines that the filter coefficient is in a saturation state, detection unit 118 changes the value of amplitude coefficient R(n) to increase the amplitude of cancelling sound 14. This configuration enables the difference of the amplitude between cancelling sound 14 and the amplitude of noise 15 to be reduced, so that error signal e(n) is reduced. As a result, the filter coefficient determined by calculation in filter coefficient update unit 115 is reduced, and the saturation state is eliminated. Therefore, an excellent noise reduction effect is obtained.

Detection unit 118 changes the value of amplitude coefficient R(n) in such a manner that detection unit 118 increases and decreases a specified value for each time. For example, it is preferable that the value of amplitude coefficient R(n) is changed for each step. With this configuration, amplitude adjustment unit 117 can control the amplitude of cancelling sound 14 precisely. Therefore, noise 15 can be effectively reduced.

Note here that an increase/decrease width of the value of amplitude coefficient R(n) may be two steps or more. In this case, the change of the amplitude of cancelling sound 14 can be increased. Therefore, the amplitude of cancelling sound 14 can be allowed to quickly follow the rapid change of the amplitude of noise 15. Therefore, noise 15 can be reduced quickly.

Alternatively, the increase/decrease width of the value of amplitude coefficient R(n) may be changed. For example, when noise 15 is rapidly changed, error signal e(n) and the filter coefficient are rapidly changed. Thus, the increase/decrease width of the value of amplitude coefficient R(n) may be defined in response to a change amount of error signal e(n) or the filter coefficient. In other words, the larger the change amount of the error signal e(n) or the filter coefficient is, the larger the increase/decrease width of the value of amplitude coefficient R(n) is made. With this configuration, noise 15 can be reduced further efficiently.

In this case, storage unit 116 stores previous error signal e(n−1) or a previous filter coefficient. When detection unit 118 defines the increase/decrease width of the value of amplitude coefficient R(n) in response to the increase/decrease width of error signal e(n), detection unit 118 compares the previous error signal e(n−1) and the present error signal e(n) with each other. On the other hand, when detection unit 118 defines the increase/decrease width of the value of amplitude coefficient R(n) in response to the increase/decrease width from the previous filter coefficient, detection unit 118 compares the previous filter coefficient and the present filter coefficient with each other. Note here that the previous error signal e(n−1) or the previous filter coefficient are stored in storage unit 116.

It is preferable that detection unit 118 determines the saturation of the filter coefficient based on an absolute value of the filter coefficient. In this case, in a state in which a value of the filter coefficient is near 1, the filter coefficient is saturated in the upper side, and in a state in which a value of the filter coefficient is near 0, the filter coefficient is saturated in the lower side.

The following is a description of an operation in which detection unit 118 judges that the filter coefficient is saturated when the value of the filter coefficient is near 1. Detection unit 118 compares the absolute value of the detected filter coefficient with the upper threshold. Then, when the absolute value of the filter coefficient exceeds the upper threshold, detection unit 118 determines that the filter coefficient is saturated. Therefore, for example, it is preferable that storage unit 116 stores the upper threshold. Note here that when detection unit 118 makes determination based on the absolute value of the filter coefficient, the upper threshold is set to a value of smaller than 1 and near 1. For example, the upper threshold can be set to a value of 0.9 or more and less than 1.

Note here that it is preferable that detection unit 118 determines whether or not saturation occurs based on only one filter coefficient of first filter coefficient W1(n) and second filter coefficient W2(n). With this configuration, detection unit 118 can quickly determine whether or not the filter coefficient is saturated. As a result, active-noise-reduction device 111 can suppress divergence of the filter coefficient. Furthermore, since the storage capacity of RAM in storage unit 116 can be saved, small RAM can be used.

Note here that the upper threshold is not necessarily limited to one value. For example, two or more upper thresholds may be provided. In this case, values of amplitude coefficients R(n) are set corresponding to the range of a plurality of thresholds, respectively. As a result, the amplitude coefficient R(n) can be changed to an optimal value quickly. Therefore, detection unit 118 can reduce noise 15, quickly.

Furthermore, detection unit 118 may be configured to monitor filter coefficients for a predetermined time (or in the defined number), and to determine whether or not the filter coefficients are saturated based on the plurality of filter coefficients. Also in this case, it is determined that the filter coefficient is saturated when it exceeds the upper threshold. Detection unit 118 changes the value of amplitude coefficient R(n) based on the monitored results. Note here that storage unit 116 stores defined time (or defined numbers) of the past filter coefficients the past filter coefficients.

For example, detection unit 118 may determine that the filter coefficient is saturated when detection unit 118 monitors the filter coefficients for a predetermined time (or in the defined number) and a maximum filter coefficient thereof exceeds the upper threshold.

Alternatively, when detection unit 118 determines that the filter coefficient is in a range of saturation in two consecutive times, detection unit 118 may determine that the filter coefficient is saturated. In other words, when the newest filter coefficient is saturated, but the previous filter coefficient is not saturated, detection unit 118 does not change the value of amplitude coefficient R(n). However, when detection unit 118 judges that both the previous and newest filter coefficients are in a saturation state, detection unit 118 determines that the filter coefficient is saturated, and increases the value of amplitude coefficient R(n). Detection unit 118 may determine that the filter coefficient is saturated in the case where the filter coefficient is in a range of saturation in three or more consecutive times, in addition to the case where the filter coefficient is in a range of saturation in two consecutive times.

Furthermore, detection unit 118 may determine that the filter coefficient is saturated when detection unit 118 determines that both two filter coefficients exceed the upper threshold in which the newest filter coefficient approaches the tendency of saturation with respect to the previous filter coefficient. In other words, detection unit 118 determines that the filter coefficient is saturated when detection unit 118 determines that the newest filter coefficient is less than 1 and more than the previous filter coefficient. Namely, detection unit 118 determines that the filter coefficient is saturated when detection unit 118 senses that the previous and newest filter coefficients are in a saturation range, and the newest filter coefficient is increased as compared with the previous filter coefficient. Then, detection unit 118 changes the value of amplitude coefficient R(n) such that the amplitude of amplitude adjustment unit 117 is increased.

Note here that when the newest filter coefficient exceeds the upper threshold, but the previous filter coefficient does not exceed the upper threshold, detection unit 118 does not change the value of amplitude coefficient R(n). Furthermore, even if both the previous and the newest filter coefficients exceed the upper threshold, when the filter coefficient is the same as the previous filter coefficient or is changed such that the saturation is eliminated (the value of the filter coefficient becomes smaller), detection unit 118 determines that the filter coefficient is not saturated and does not change the value of amplitude coefficient R(n).

With the above-mentioned configuration, detection unit 118 judges whether or not the filter coefficient is saturated from change of a plurality of filter coefficients. Therefore, even when the filter coefficient fluctuates in a vicinity of the upper threshold, detection unit 118 can switch the values of amplitude coefficients R(n) stably.

Furthermore, detection unit 118 may be configured to estimate whether or not a filter coefficient is saturated when a value of amplitude coefficient R(n) is changed. In this case, detection unit 118 changes the value of amplitude coefficient R(n) when it estimates that the filter coefficient is not saturated even if the value of amplitude coefficient R(n) is changed.

Next, an operation in which detection unit 118 determines that the filter coefficient is saturated when the value of the filter coefficient is near 0 is described. In this case, detection unit 118 determines whether or not the filter coefficient is saturated based on a plurality of past detected filter coefficients. Therefore, detection unit 118 observes the filter coefficients during a predetermined time. Then, when detection unit 118 determines that the filter coefficient is saturated when a value of the filter coefficient is near 0, it can be estimated that the filter coefficient is reduced and the filter coefficient is not saturated even if the value of amplitude coefficient R(n) is changed. In this case, detection unit 118 changes the value of amplitude coefficient R(n) such that the amplitude of amplitude adjustment unit 117 is reduced.

With this configuration, since a dynamic range of the filter coefficient is increased, even if error signal e(n) is small, noise can be further reduced.

Note here that time (number) in which detection unit 118 observes the filter coefficient needs to be larger than time (or number) in which it can be determined that the filter coefficient is reduced. It is preferable that detection unit 118 judges that the filter coefficient is in a saturation state when detection unit 118 determines that the plurality of the detected past filter coefficients stably move in a saturation region around 0. Detection unit 118 can determine that the filter coefficient is saturated when, for example, a plurality of consecutive filter coefficients are in the saturation region from the present time to the previous time. Therefore, detection unit 118 compares the detected filter coefficient with the lower threshold. Note here that an absolute value of the lower threshold is near 0. For example, the lower threshold can be set to 0 or more and 0.1 or less. Note here that it is preferable that the lower threshold is stored in storage unit 116.

Furthermore, detection unit 118 may estimate whether or not a next time filter coefficient is saturated by using the present and past filter coefficients. In this case, detection unit 118 estimates whether or not the filter coefficient is saturated even if the value of amplitude coefficient R(n) is changed.

Note here that the lower threshold is not necessarily one value. Two or more lower thresholds may be provided. In this case, the values of amplitude coefficients R(n) are set corresponding to a range defined by the lower-limit thresholds, respectively. As a result, the value of amplitude coefficient R(n) can be changed to an optimal value quickly. Therefore, noise 15 can be reduced quickly.

Figure 3:
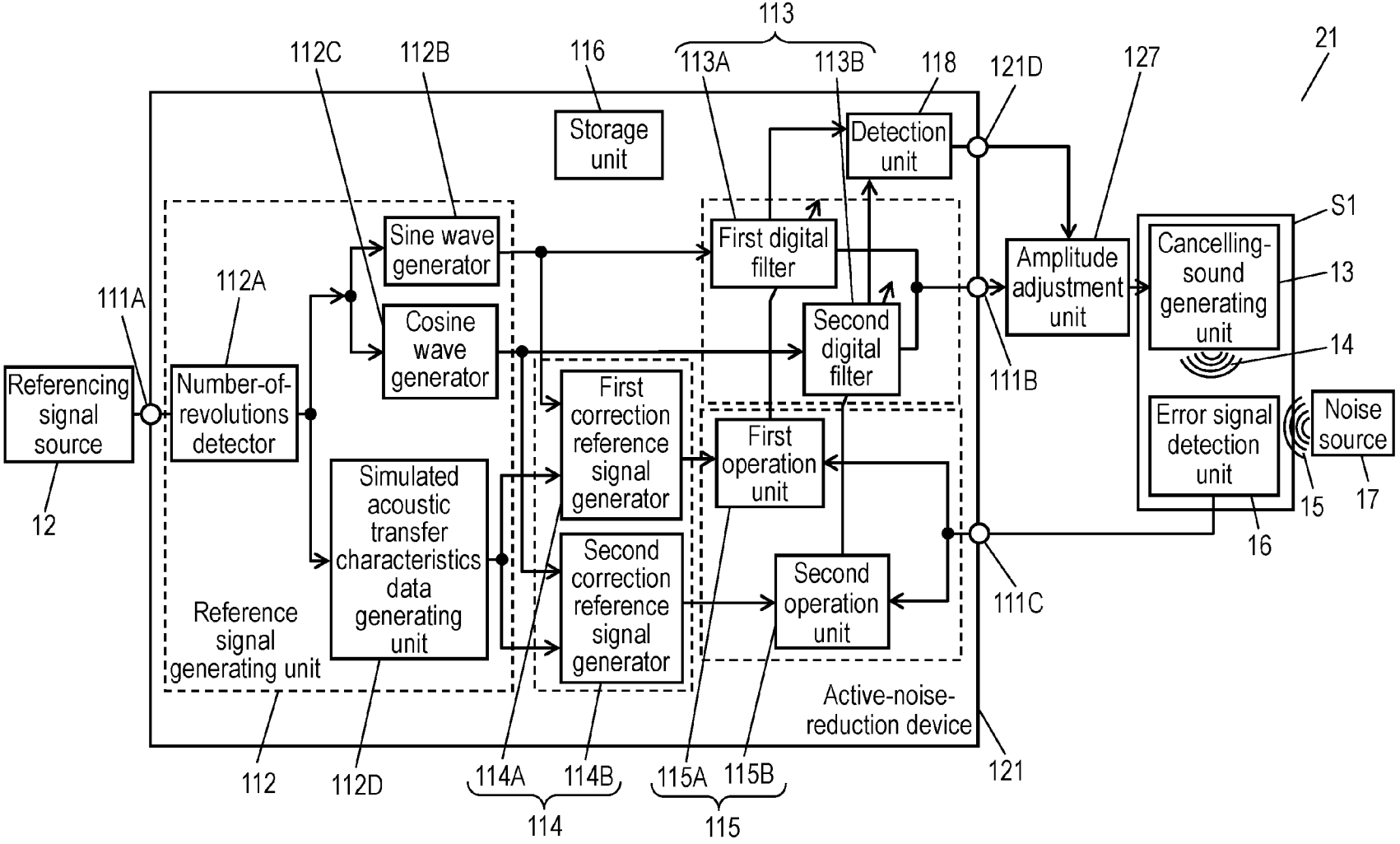
FIG. 3 is a circuit block diagram of an active-noise-reduction system in another example in accordance with the exemplary embodiment of the present invention.

FIG. 3 is a circuit block diagram of active-noise-reduction system 21 in another example in accordance with the exemplary embodiment of the present invention. Active-noise-reduction system 21 in this example includes active-noise-reduction device 121 instead of active-noise-reduction device 111 of active-noise-reduction system 11. Active-noise-reduction device 121 is different from active-noise-reduction device 111 in that active-noise-reduction device 121 does not include amplitude adjustment unit 117. That is to say, an output of adaptive filter unit 113 is directly supplied to output terminal 111B. Amplitude adjustment unit 127 is provided between output terminal 111B and cancelling-sound generating unit 13. Therefore, cancelling signal z(n) is supplied to cancelling-sound generating unit 13 via amplitude adjustment unit 127. Note here that amplitude adjustment unit 127 is not necessary provided between output terminal 111B and cancelling-sound generating unit 13. For example, amplitude adjustment unit 127 may be included in cancelling-sound generating unit 13.

Amplitude adjustment unit 127 includes an amplitude control terminal. Amplitude adjustment unit 127 adjusts an amplitude of cancelling signal z(n) output from amplitude adjustment unit 127 in response to a control signal supplied to the amplitude control terminal. Thus, active-noise-reduction device 121 is provided with control signal terminal 121D. Then, detection unit 118 supplies a control signal to the amplitude control terminal of amplitude adjustment unit 127 via control signal terminal 121D. With such a configuration, the amplitude of cancelling sound 14 is adjusted in response to a filter coefficient detected by detection unit 118.

In this case, it is preferable that cancelling signal z(n) input into amplitude adjustment unit 127 is converted into an analog signal. With such a configuration, the amplitude of cancelling signal z(n) cannot be easily influenced by the resolution by the number of bits of microcomputer or the like. Therefore, extremely precise amplitude control can be carried out.

Alternatively, for amplitude adjustment unit 127, a digital variable resistor may be used. In this case, a digital control signal output by active-noise-reduction device 121 enables easy control of the amplitude. Note here that amplitude adjustment unit 127 is not necessarily limited to the digital variable resistor. Examples thereof include an analog variable resistor, a circuit in which a resistor, a switch, and the like, are combined in multiples stages, a variable gain amplifier, or the like. Use of such circuits enables a phase delay of cancelling signal z(n) in amplitude adjustment unit 127 to be made extremely reduced. Therefore, it is not necessary to adjust a phase in response to the amplitude of amplitude adjustment unit 127.

Figure 4:
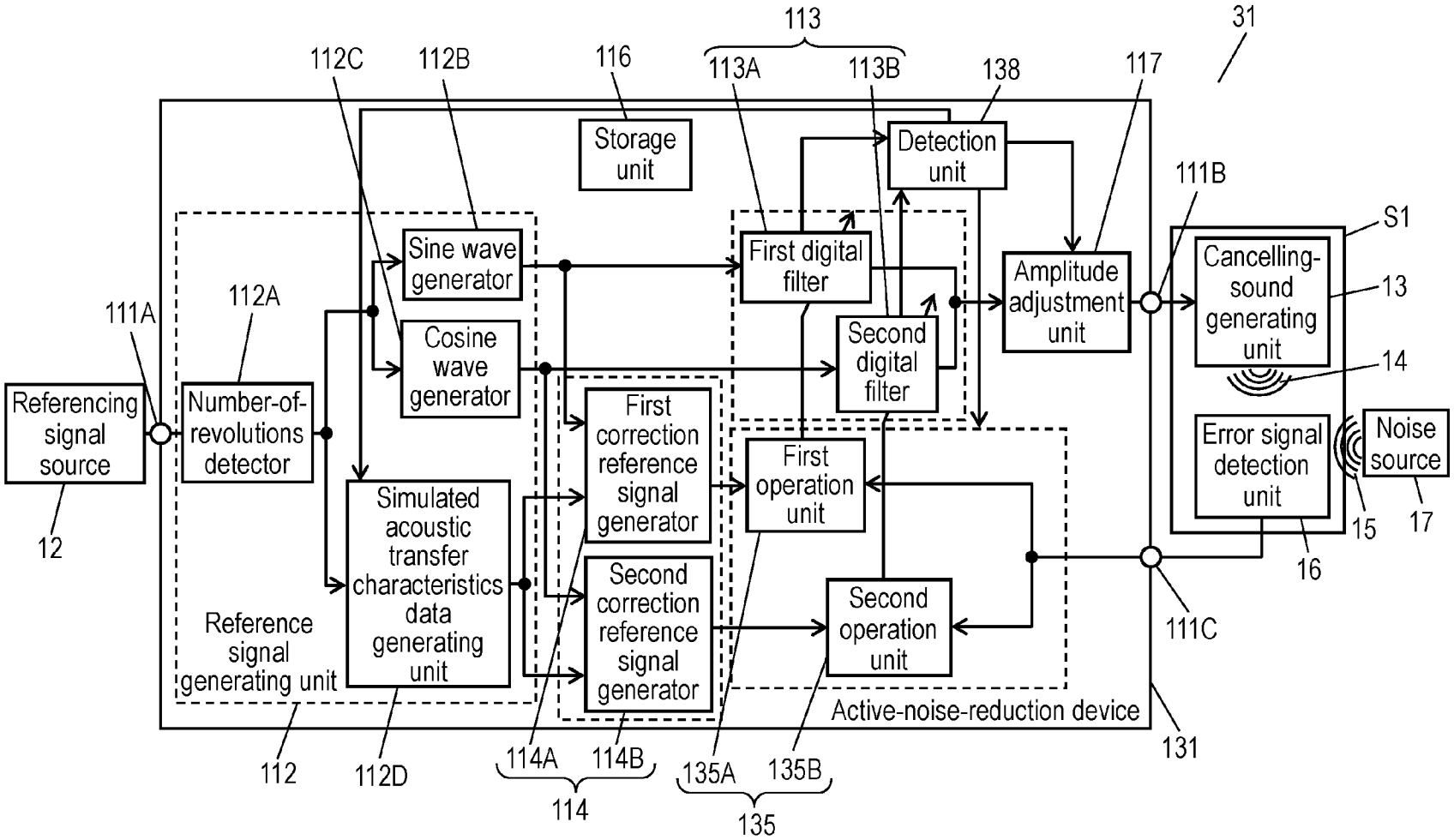
FIG. 4 is a circuit block diagram of an active-noise-reduction system in still another example in accordance with the exemplary embodiment of the present invention.

FIG. 4 is a circuit block diagram of active-noise-reduction system 31 in still another example in accordance with the exemplary embodiment of the present invention. Active-noise-reduction system 31 includes active-noise-reduction device 131 instead of active-noise-reduction device 111 of active-noise-reduction system 11. Active-noise-reduction device 131 includes detection unit 138 and filter coefficient update units 135 (first and second operation units 135A and 135B) instead of detection unit 118 and filter coefficient update unit 115 (first and second operation units 115A and 115B).

In addition to the operation of detection unit 118, detection unit 138 changes a step-size parameter μ(n) in response to the value of amplitude coefficient R(n) when the value of amplitude coefficient R(n) of amplitude adjustment unit 117. Then, detection unit 138 outputs the changed step-size parameter μ(n) to filter coefficient update unit 135. Furthermore, detection unit 138 generates a correction value of simulated acoustic transfer characteristics data in response to the value of amplitude coefficient R(n) when the value of amplitude coefficient R(n) of amplitude adjustment unit 117 is changed. Namely, detection unit 138 generates, for example, a correction value of gain correction value Gain(k) corresponding to the value of amplitude coefficient R(n).

First operation unit 135A and second operation unit 135B receive an input of step-size parameter μ(n) from detection unit 138 in addition to the operation of first operation unit 115A and second operation unit 115B. Then, first operation unit 135A and second operation unit 135B determine a filter coefficient by calculation by using the input step-size parameter μ(n). As a result, the filter coefficient is updated to a value in response to μ(n) changed by detection unit 138.

In this case, updating formulae of first filter coefficient W1(n) and second filter coefficient W2(n) are represented by Formulae 14 and 15, respectively, where r1(n) denotes a correction sine wave signal, r2(n) denotes a correction cosine wave signal, and e(n) denotes an error signal.

[Math. 13]

$$W1(n)=W1(n-1)-\mu(n)\times r1(n)\times e(n) \quad \text{(Formula 14)}$$

$$W2(n)=W2(n-1)-\mu\times r2(n)\times e(n) \quad \text{(Formula 15)}$$

When detection unit 138 detects that first filter coefficient W1(n) or second filter coefficient W2(n) is saturated to the upper side, detection unit 138 increases the value of amplitude coefficient R(n). As a result, a gain of the device as a whole can be increased and an update speed is increased, thus improving responsibility. However, when the update speed is too high, first filter coefficient W1(n) and second filter coefficient W2(n) cannot converge and they may diverge. Thus, detection unit 138 changes step-size parameter μ(n) so as to adjust to slow the update speed. As a result, it is possible to suppress divergence of first filter coefficient W1(n) or second filter coefficient W2. Therefore, noise 15 can be reduced excellently, and active-noise-reduction device 131 can be operated stably. Note here that active-noise-reduction device 131 shown in FIG. 4 includes amplitude adjustment unit 117, but amplitude adjustment unit 127 may be disposed outside active-noise-reduction device 131 as in active-noise-reduction device 121 shown in FIG. 3.

Furthermore, simulated acoustic transfer characteristics data generating unit 112D corrects simulated acoustic transfer characteristics data based on a correction value generated by detection unit 138, and outputs them to correction unit 114. As a result, correction unit 114 outputs a correction reference signal corrected in response to the value of amplitude coefficient R(n). Therefore, filter coefficient update unit 135 updates the filter coefficient based on the correction reference signal.

With the above-mentioned configuration, by correcting gain correction value Gain(k) of simulated acoustic transfer characteristics data generating unit 112D, it is possible to adjust a speed at which first filter coefficient W1(n) and second filter coefficient W2(n) are updated. Therefore, even when it is difficult to adjust the update speed by step-size parameter μ(n), the update speed can be adjusted excellently.

Note here that detection unit 138 is configured to correct the simulated acoustic transfer characteristics data in response to the value of amplitude coefficient R(n), but the configuration is not limited to this. For example, simulated acoustic transfer characteristics data generating unit 112D or correction unit 114 may correct simulated acoustic transfer characteristics data in response to the value of amplitude coefficient R(n). In this case, detection unit 138 supplies simulated acoustic transfer characteristics data generating unit 112D or correction unit 114 with the value of amplitude coefficient R(n).

Furthermore, detection unit 138 may output only one of change of step-size parameter μ(n) and correction of gain correction value Gain(k) of simulated acoustic transfer characteristics data generating unit 112D. Alternatively, detection unit 138 may select and output any one of the change of step-size parameter μ(n) and the correction value of gain correction value Gain(k) of simulated acoustic transfer characteristics data generating unit 112D. With these configurations, the update speed can be adjusted excellently.

When reference signal generating unit 112, adaptive filter unit 113, correction unit 114, filter coefficient update unit 115, storage unit 116, further, processing blocks such as amplitude adjustment unit 117, first operation unit 135A and second operation unit 135B, and detection unit 138 are configured inside a signal processing device, these processing units are preferably configured by software. Furthermore, amplitude adjustment unit 127 may be also configured by software. In this case, it is not necessary to mount many electronic components to configure these processing units. As a result, active-noise-reduction device 111, active-noise-reduction device 121, active-noise-reduction device 131, or active-noise-reduction system 11, active-noise-reduction system 21, and active-noise-reduction system 31 can be miniaturized. Furthermore, productivity of active-noise-reduction device 111, active-noise-reduction device 121, active-noise-reduction device 131, or active-noise-reduction system 11, active-noise-reduction system 21, and active-noise-reduction system 31 is also improved.

Figure 5:
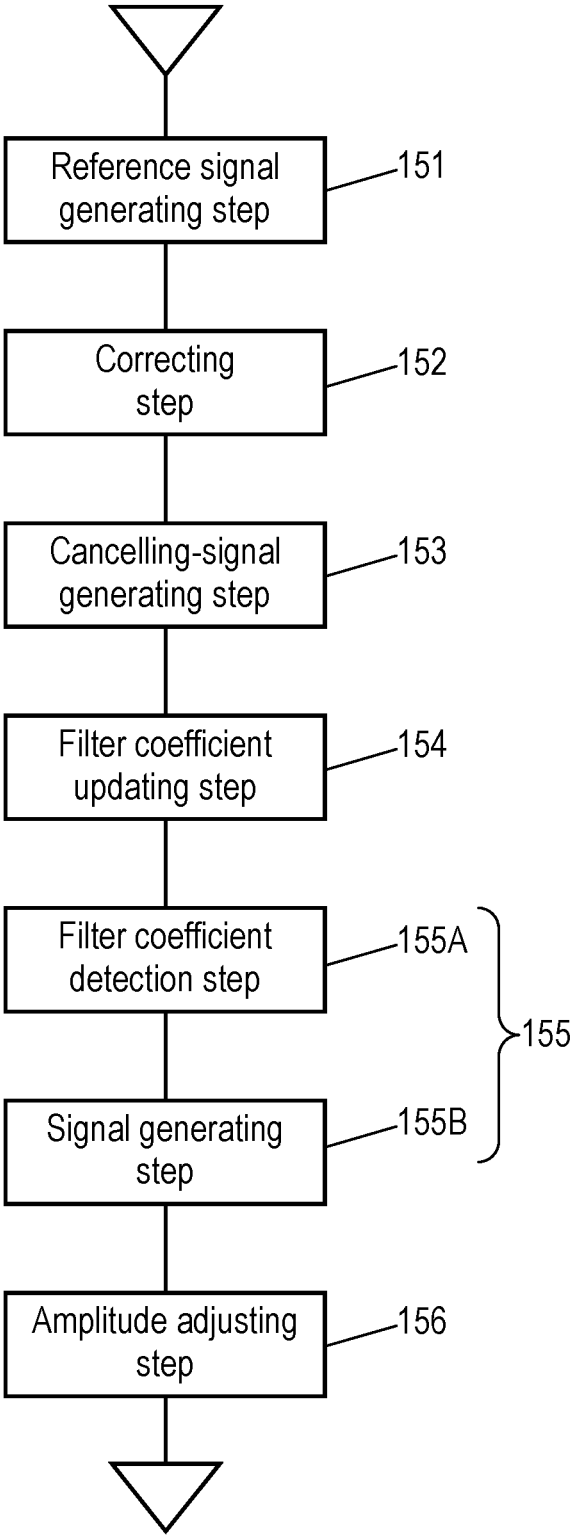
FIG. 5 is a control flowchart of active noise reduction in accordance with the exemplary embodiment of the present invention.
Figure 6:
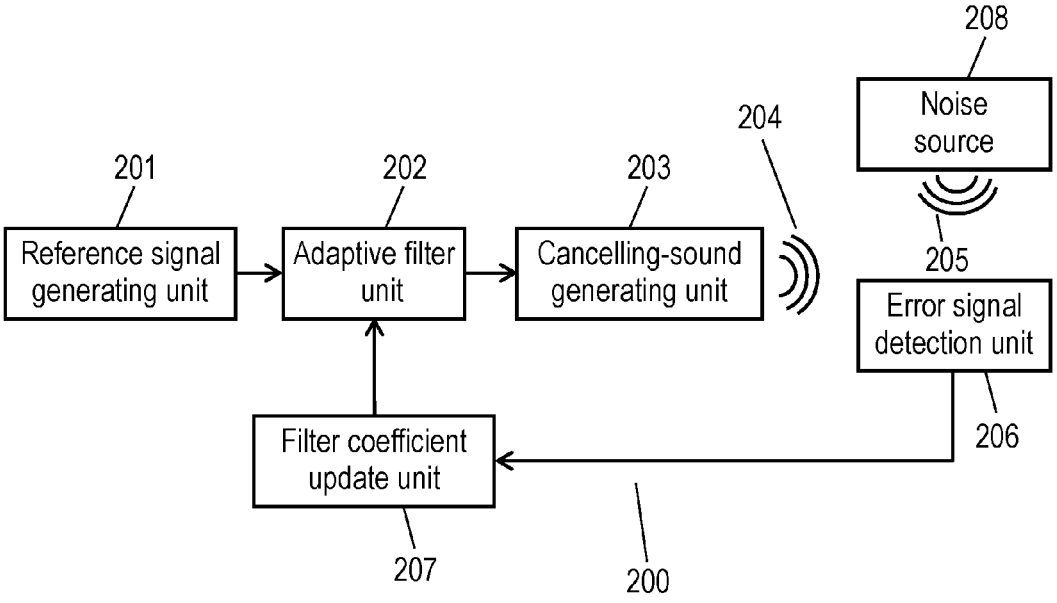
FIG. 6 PRIOR ART
FIG. 6 is a circuit block diagram of a conventional active-noise-reduction device.

FIG. 5 is a control flowchart of an active noise reduction device in accordance with the exemplary embodiment of the present invention. A main control flow of active-noise-reduction device 111, active-noise-reduction device 121 or active-noise-reduction device 131 includes a reference signal generating step 151, correction step 152, cancelling-signal generating step 153, filter coefficient updating step 154, and controlling step 155. Furthermore, the main control flow may include amplitude adjusting step 156. Furthermore, it is preferable that controlling step 155 includes filter coefficient detection step 155A and signal generating step 155B.

In reference signal generating step 151, processing of reference signal generating unit 112 is carried out. In correcting step 152, processing of correction unit 114 is carried out. In cancelling-signal generating step 153, processing of adaptive filter unit 113 is carried out. Furthermore, in filter coefficient updating step 154, processing of filter coefficient update unit 115, or processing of first operation unit 135A and second operation unit 135B is carried out. Furthermore, in controlling step 155, processing of detection unit 118 or detection unit 138 is carried out. Note here that in filter coefficient detection step 155A, processing for detecting filter coefficient in the processing of detection unit 118 or detection unit 138 is carried out. On the other hand, in signal generating step 155B, a signal output from detection unit 118 or detection unit 138 is output. In signal generating step 155B, a control signal for adjusting, for example, correction values of the amplitude of cancelling signal z(n), step-size parameter μ(n), and gain correction value Gain(k) are generated.

Then, in amplitude adjusting step 156, processing of amplitude adjustment unit 117 or amplitude adjustment unit 127 is carried out.

Note here that controlling step 155 or amplitude adjusting step 156 may be configured as subroutine. Furthermore, configurations of these processing units are not necessarily limited to configuration by software. For example, these processing blocks may be formed by a special-purposed processing circuit using mounted components or the like.

INDUSTRIAL APPLICABILITY

An active-noise-reduction device in accordance with the present invention is useful as a device for reducing noise in an automobile.

REFERENCE MARKS IN THE DRAWINGS

11 active-noise-reduction system
12 referencing signal source
13 cancelling-sound generating unit
14 cancelling sound
15 noise
16 error signal detection unit
17 noise source
21 active-noise-reduction system
31 active-noise-reduction system
111 active-noise-reduction device
111A first input terminal
111B output terminal
111C second input terminal
112 reference signal generating unit
112A number-of-revolutions detector
112B sine wave generator
112C cosine wave generator
112D simulated acoustic transfer characteristics data generating unit
113 adaptive filter unit
113A first digital filter
113B second digital filter
114 correction unit
114A first correction reference signal generator
114B second correction reference signal generator
115 filter coefficient update unit
115A first operation unit
115B second operation unit
116 storage unit
117 amplitude adjustment unit
118 detection unit
121 active-noise-reduction device
121D control signal terminal
127 amplitude adjustment unit
131 active-noise-reduction device
135 filter coefficient update unit
135A first operation unit
135B second operation unit
138 detection unit
151 reference signal generating step
152 correcting step
153 cancelling-signal generating step

154 filter coefficient updating step
155 controlling step
155A filter coefficient detection step
155B signal generating step
156 amplitude adjusting step
200 active-noise-reduction system
201 reference signal generating unit
202 adaptive filter unit
203 cancelling-sound generating unit
204 cancelling sound
205 noise
206 error signal detection unit
207 filter coefficient update unit
208 noise source
501 mobile device
502 device main body
503 drive unit
504 tire
S1 space

The invention claimed is:

1. An active-noise-reduction device, comprising:
a first input terminal for receiving, from outside, a signal having a correlation with noise;
a signal processing device configured to provide:
a reference signal generating unit configured to output a reference signal based on the signal having the correlation with noise;
an adaptive filter unit into which the reference signal is input and from which a cancelling signal is output; and
a correction unit into which the reference signal is input and configured to generate a correction reference signal based on simulated acoustic transfer characteristics data that simulate acoustic transfer characteristics of a signal transfer path of the cancelling signal;
an output terminal for supplying the cancelling signal to outside;
a second input terminal into which an error signal based on a residual sound by interference between the cancelling signal and the noise is input;
wherein the signal processing device is further configured to provide:
a filter coefficient update unit configured to sequentially update a filter coefficient of the adaptive filter unit based on the error signal and the correction reference signal; and
a detection unit configured to detect the filter coefficient,
wherein the detection unit generates a control signal for adjusting an amplitude of the cancelling signal based on the detected filter coefficient.

2. The active-noise-reduction device of claim 1, wherein the detection unit estimates whether or not the filter coefficient is saturated when the amplitude of the cancelling signal is reduced, and
when the detection unit estimates that the filter coefficient is not saturated, the detection unit reduces the amplitude of the cancelling signal by the control signal.

3. The active-noise-reduction device of claim 1, wherein when the detection unit determines that the filter coefficient is in a saturation state, the detection unit adjusts the amplitude of the cancelling signal such that the saturation state is eliminated by the control signal.

4. The active-noise-reduction device of claim 3, wherein when the detection unit detects that the filter coefficient of the adaptive filter unit exceeds an upper threshold, the detection unit determines that the filter coefficient is in a saturation state and increases the amplitude of the cancelling signal by the control signal.

5. The active-noise-reduction device of claim 3, wherein the detection unit monitors the filter coefficient for a predetermined time, for obtaining a plurality of filter coefficients, and determines whether or not the filter coefficient is in a saturation state based on the plurality of filter coefficients.

6. The active-noise-reduction device of claim 5, wherein when the detection unit detects that a maximum value of the plurality of filter coefficients exceeds a predetermined upper threshold, the detection unit determines that the filter coefficient is in a saturation state and reduces the amplitude of the cancelling signal by the control signal.

7. The active-noise-reduction device of claim 5, wherein when the detection unit detects that two or more consecutive filter coefficients in the plurality of filter coefficients exceed a predetermined upper threshold, the detection unit determines that the filter coefficient is in a saturation state.

8. The active-noise-reduction device of claim 5, wherein when the detection unit detects that two or more consecutive filter coefficients in the plurality of filter coefficients exceed a predetermined upper threshold and detects that a newest filter coefficient in the plurality of filter coefficients is changed so as to be saturated with respect to a previous filter coefficient, the detection unit determines that the filter coefficient is in a saturation state, and reduces the amplitude of the cancelling signal by the control signal.

9. The active-noise-reduction device of claim 1, wherein the detection unit monitors the filter coefficient for a predetermined time, for obtaining a plurality of filter coefficients, estimates whether or not the filter coefficient is saturated based on the plurality of filter coefficients when the amplitude of the cancelling signal is reduced, and reduces the amplitude of the cancelling signal by the control signal when the detection unit estimates that the filter coefficient is not saturated even if the amplitude of the cancelling signal is reduced.

10. The active-noise-reduction device of claim 1, wherein when the detection unit monitors the filter coefficient for a predetermined time, for obtaining a plurality of filter coefficients and detects that a maximum value in the plurality of filter coefficients is a predetermined lower threshold or less, the detection unit reduces the amplitude of the cancelling signal by the control signal.

11. The active-noise-reduction device of claim 1, further comprising an amplitude adjustment unit between the adaptive filter unit and the output terminal,
wherein the detection unit supplies the amplitude adjustment unit with the control signal, and the amplitude adjustment unit adjusts the amplitude of the cancelling signal based on the control signal.

12. The active-noise-reduction device of claim 1, wherein the detection unit adjusts a step-size parameter of the filter coefficient update unit based on a value of the control signal, and supplies the filter coefficient update unit with the adjusted step-size parameter.

13. The active-noise-reduction device of claim 1, wherein an output from the detection unit is supplied to the correction unit or the reference signal generating unit, and the filter coefficient update unit updates the filter coefficient based on a correction reference signal corrected in response to the output from the detection unit.

14. The active-noise-reduction device of claim 1, further comprising an amplitude adjustment unit between the adaptive filter unit and the output terminal, wherein the amplitude adjustment unit is supplied with the control signal, and adjusts the amplitude of the cancelling signal.

15. An active-noise-reduction system comprising:

an active-noise-reduction device as defined in claim 1; and a referencing signal source configured to generate a referencing signal to be supplied to the active-noise-reduction device, the referencing signal having a correlation with noise;

a transducer device configured to provide a cancelling sound source for generating a cancelling sound based on a cancelling signal output from the active-noise-reduction device;

an amplitude adjustment unit provided between the cancelling sound source and an adaptive filter unit of the active-noise-reduction device; and an error signal detection circuit configured to generate an error signal based on a residual sound by interference between the cancelling sound and the noise, and outputting the error signal to the active-noise-reduction device;

wherein the amplitude adjustment unit is supplied with a control signal output from the detection unit of the active-noise-reduction device, and controls an amplitude of the cancelling signal based on the control signal.

16. A mobile device comprising:

a device main body;

a drive unit and an active-noise-reduction system mounted on the device main body; and a space provided in the device main body, wherein the active-noise-reduction system comprises:

an active-noise-reduction device as defined in claim 1; and a referencing signal source configured to generate a referencing signal to be supplied to the active-noise-reduction device, the referencing signal having a correlation with noise;

a transducer device configured to provide a cancelling sound source for generating a cancelling sound based on a cancelling signal output from the active-noise-reduction device;

an amplitude adjustment unit provided between the cancelling sound source and an adaptive filter of the active-noise-reduction device; and an error signal detection circuit configured to generate an error signal based on a residual sound by interference between the cancelling sound and the noise and outputting the error signal to the active-noise-reduction device, wherein the cancelling sound source is placed such that the cancelling sound can be output to the space, the error signal detection circuit is placed in the space such that the residual sound can be detected, and the amplitude adjustment unit is supplied with a control signal output by the detection unit of the active-noise-reduction device and controls an amplitude of the cancelling signal based on the control signal.

17. An active-noise-reduction method comprising:

generating a referencing signal having a correlation with noise generated from a noise source;

generating a cancelling signal by an adaptive filter based on the reference signal;

updating a filter coefficient of the adaptive filter based on an error signal generated by interference between the noise and the cancelling signal;

detecting the updated filter coefficient; and generating a control signal for adjusting an amplitude of the cancelling signal in response to the filter coefficient detected in the detecting of the filter coefficient, wherein the detecting of the filter coefficient estimates whether or not the filter coefficient is saturated when the amplitude of the cancelling sound is reduced, and when the detecting of the filter coefficient estimates that the filter coefficient is not saturated, the generating of a control signal generates the control signal such that the amplitude of the cancelling signal is reduced.

18. The active-noise-reduction method of claim 17, wherein the detecting of the filter coefficient monitors the filter coefficient for a predetermined time, for obtaining a plurality of filter coefficients, and estimates whether or not the filter coefficient is saturated based on the plurality of filter coefficients when the amplitude of the cancelling signal is reduced, and when the detecting of the filter coefficient estimates that the filter coefficient is not saturated even if the amplitude is reduced, the generating of the control signal generates the control signal such that the amplitude of the cancelling signal is reduced.

19. The active-noise-reduction method of claim 17, wherein the detecting of the filter coefficient monitors the filter coefficient for a predetermined time, for obtaining a plurality of filter coefficients, estimates that the filter coefficient is not saturated even if the amplitude is reduced when it is detected that a maximum value in the plurality of filter coefficients is not more than a predetermined lower threshold, and when the detecting of the filter coefficient estimates that the filter coefficient is not saturated even if the amplitude is reduced, the generating of the control signal generates the control signal such that the amplitude of the cancelling signal is reduced.

20. The active-noise-reduction method of claim 17, wherein the generating of the control signal generates a step-size parameter of the adaptive filter in response to a value of the control signal, and the updating of the filter coefficient updates the filter coefficient by using the generated step-size parameter.

21. The active-noise-reduction method of claim 17, further comprising generating of the referencing signal, which generates a correction signal based on simulated acoustic transfer characteristics data that simulate acoustic transfer characteristics of a signal transfer path of the cancelling signal, wherein the generating of the control signal generates a correction value of the simulated acoustic transfer characteristics data in response to a size of the control signal, and the updating of the filter coefficient updates the filter coefficient based on the correction value by using the correction signal.

22. The active-noise-reduction method of claim 17, further comprising adjusting the amplitude of the cancelling signal based on the control signal.

23. An active-noise-reduction method comprising:

generating a referencing signal having a correlation with noise generated from a noise source:

generating a cancelling signal by an adaptive filter based on the reference signal;

updating a filter coefficient of the adaptive filter based on an error signal generated by interference between the noise and the cancelling signal;

detecting the updated filter coefficient; and generating a control signal for adjusting an amplitude of the cancelling signal in response to the filter coefficient detected in the detecting of the filter coefficient, wherein the detecting of the filter coefficient determines whether or not the filter coefficient is in a saturation state, and when the detecting of the filter coefficient determines that the filter coefficient is in a saturation state, the generating of the control signal generates the control signal such that the saturation state of the filter coefficient is eliminated.

24. The active-noise-reduction method of claim 23, wherein the detecting of the filter coefficient determines that the filter coefficient is in a saturation state when it is determined that the filter coefficient of the adaptive filter exceeds an upper threshold, and when the detecting of the filter coefficient determines that the filter coefficient is in a saturation state, the generating of the control signal generates the control signal such that the amplitude of the cancelling signal is increased.

25. The active-noise-reduction method of claim 23, wherein the detecting of the filter coefficient monitors the filter coefficient for a predetermined time, for obtaining a plurality of filter coefficients, and determines whether or not the filter coefficient is in a saturation state based on the plurality of filter coefficients.

26. The active-noise-reduction method of claim 25, wherein the detecting of the filter coefficient determines that the filter coefficient is in a saturation state when it is detected that a maximum value in the plurality of filter coefficients exceeds a predetermined upper threshold, and when the detecting of the filter coefficient determines that the filter coefficient is in a saturation state, the generating of the control signal generates the control signal such that the amplitude is reduced.

27. The active-noise-reduction method of claim 25, wherein the detecting of the filter coefficient determines that the filter coefficient is in a saturation state when it is detected that two or more consecutive filter coefficients in the plurality of filter coefficients exceed a predetermined upper threshold, and when the detecting of the filter coefficient determines that the filter coefficient is in a saturation state, the generating of the control signal generates the control signal such that the amplitude is reduced.

28. The active-noise-reduction method of claim 25, wherein the detecting of the filter coefficient determines that the filter coefficient is in a saturation state when it is detected that two or more consecutive filter coefficients in the plurality of filter coefficients exceed a predetermined upper threshold and a newest filter coefficient in the monitored filter coefficients is changed to be saturated with respect to a previous filter coefficient, and when the detecting of the filter coefficient determines that the filter coefficient is changed to be saturated, the generating of the control signal generates the control signal such that the amplitude is reduced.

* * * * *